US007059399B2

(12) United States Patent
Chin et al.

(10) Patent No.: US 7,059,399 B2
(45) Date of Patent: Jun. 13, 2006

(54) HEAT EXCHANGER WITH FLAT TUBES

(75) Inventors: Sim Won Chin, Gwangmyeong-si (KR); Kee Soo Hong, Anyang-si (KR); Moon Kee Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 115 days.

(21) Appl. No.: 10/755,324

(22) Filed: Jan. 13, 2004

(65) Prior Publication Data

US 2005/0051317 A1 Mar. 10, 2005

(30) Foreign Application Priority Data

Sep. 4, 2003 (KR) ..... 10-2003-0061858

(51) Int. Cl.
*F28F 1/40* (2006.01)
*F28F 1/42* (2006.01)

(52) U.S. Cl. ..... 165/177; 165/146

(58) Field of Classification Search ..... 165/177, 165/146, 147, 152, 183
See application file for complete search history.

(56) References Cited

U.S. PATENT DOCUMENTS 2,181,927 A * 12/1939 Townsend ..... 165/147
4,570,700 A * 2/1986 Ohara et al. ..... 165/177
5,163,507 A * 11/1992 Joshi ..... 165/135
5,174,373 A * 12/1992 Shinmura ..... 165/146
5,941,303 A * 8/1999 Gowan et al. ..... 165/176
6,216,776 B1 * 4/2001 Kobayashi et al. ..... 165/177
6,749,015 B1 * 6/2004 Moreau ..... 165/177
2002/0066554 A1 * 6/2002 Oh et al. ..... 165/152

FOREIGN PATENT DOCUMENTS

| | | |
|---|---|---|
| EP | 0 030 072 | * 10/1981 |
| GB | 2 236 841 | * 4/1991 |
| JP | 60-185094 | * 9/1985 |
| JP | 3-251688 | * 11/1991 |
| JP | 10-062092 | 3/1998 |
| JP | 2000-154987 | 6/2000 |

* cited by examiner

*Primary Examiner*—Teresa J. Walberg
(74) *Attorney, Agent, or Firm*—Birch, Stewart, Kolasch & Birch, LLP

(57) ABSTRACT

A heat exchanger including first and second header tanks for receiving and discharging refrigerant. Further, the first and second header tanks are spaced apart from each other by a predetermined distance. Also include is a plurality of flat tubes each having opposite ends respectively connected to the first and second header tanks, in which each of the flat tubes has channels through which the refrigerant scatters and flows, and the channels have a different capacity from each other. Further included is a cooling member for discharging heat of the refrigerant flowing along the flat tubes.

19 Claims, 7 Drawing Sheets

(a)

(b)

HEAT EXCHANGER WITH FLAT TUBES

This Non-provisional application claims priority under 35 U.S.C. § 119(a) on Patent Application No(s). 10-2003-0061858 filed in Korea on Sep. 4, 2003, the entire contents of which are hereby incorporated by reference.

BACKGROUND OF THE INVENTION

1. Field of the Invention

The present invention relates to a heat exchanger with flat tubes, and more particularly, to a heat exchanger with flat tubes that can improve the heat exchange efficiency by making capacities of channels of each flat tube different from each other.

2. Description of the Related Art

Generally, an air conditioner for cooling interior air using a cooling cycle includes a compressor for compressing refrigerant to a high pressure, a condenser for exchanging heat of the compressed refrigerant with exterior air to liquefy refrigerant gas, and an evaporator for exchanging heat of the liquefied refrigerant with the interior air using an expansion valve or capillary tubes to evaporate the liquefied refrigerant. The air conditioner performs the cooling operation by using heat of gasification of refrigerant.

Thus, the air conditioner is configured to control the temperature of an enclosed space by inducing a phase transition of the refrigerant using a heat exchanger such as the condenser and the evaporator. Therefore, in order to improve the cooling efficiency, it is very important to improve the efficiency of the heat exchanger.

Due to the above reasons, in recent years, there appears a super compact condenser (SCC), which is designed to dramatically improve the heat-exchange efficiency by arranging a plurality of flat tubes in a zigzag-shape to allow the refrigerant to simultaneously flow. FIG. 1 shows a conventional heat exchanger with flat tubes used to perform heat exchange in an air conditioner using refrigerant.

Referring to FIG. 1, a heat exchanger with flat tubes includes first and second header tanks 10 and 20 disposed in parallel and spaced apart from each other at a predetermined distance, a plurality of refrigerant tubes 12 disposed in parallel and spaced apart from each other at a predetermined distance, opposite ends of each refrigerant tube 12 are configured to communicate with the first and second header tanks 10 and 20, respectively, and a plurality of cooling fins 14 formed on the refrigerant tubes 12 to discharge heat of the refrigerant flowing along the refrigerant tubes 12.

The first and second header tanks 10 and 20 are disposed facing each other, and refrigerant inlet and outlet tubes 16 and 18 are respectively connected to the first and second header tanks 10 and 20. In addition, at least one refrigerant separation membrane for directing refrigerant in a desired direction is disposed in the first and second header thanks 10 and 20.

In operation, the refrigerant introduced into the first header tank 10 through the refrigerant inlet tube 16 flow into the second header tank 20 along the refrigerant tubes 12 connecting the first header tank 10 to the second header tank The refrigerant reciprocally flow between the first and second header tanks 10 and 20 by the separation membranes 22 disposed in the first and second header tanks 10 and 20, and are then discharged through the refrigerant outlet tube 18 of the second header tank 20 after repeatedly moved between the first and second header tanks 10 and 20. At this point, the refrigerant generate heat in the course of flowing along the refrigerant tubes 12, and the generated heat is radiated through the cooling fins 14 surface-contacting the refrigerant tubes 12. Since the heat exchanger is used as an evaporator or a condenser, it can function to increase or decrease the temperature of interior air.

FIG. 2 shows a sectional view taken along the line A–A' of FIG. 1.

Referring to FIG. 2, the tube 12 is formed in a flat shape having a sectional structure in which refrigerant-flowing holes 12*a* of multi-channels Ch1–Chn are formed. Such a flat tube 12 is generally employed to a heat exchanger used as a high efficiency condenser.

The refrigerant is dispersed and flows along the refrigerant-flowing holes 12*a* configured in the multi-channels Ch1–Chn by a small amount. At this point, the dispersed refrigerant uniformly contacts an entire inner circumference of the respective refrigerant-flowing holes 12*a* by surface tension, so that an annular flow phenomenon is generated to increase the heat transfer efficiency. In addition, since an amount of the pressure drop is small, the flow of the refrigerant can be more stably realized.

Also, the refrigerant flowing along the header tanks 10 and 20 transfers heat through the cooling fins 14 surface-contacting an outer circumferences of the tubes 12 while passing through the multi-channels Ch1–Chn, i.e., the refrigerant flow holes 12*a*, thereby increasing or decreasing the air temperature.

Meanwhile, as described above, the refrigerant flow holes 12*a* of the flat tube are formed in a kind of the micro multi-channels Ch1, Ch2, . . . , Chn. Each of the channels has a rectangular section with an identical width. In addition, each of the foremost and rearmost channels Ch1 and Chn has a hemispherical outer end section to reduce the contact resistance with the air.

However, since the widths of channels are identical to each other and the intervals between the channels are also identical, it is difficult to maximize the heat transfer efficiency at a front end portion of the tube, thereby deteriorating the heat transfer efficiency of the heat exchanger.

SUMMARY OF THE INVENTION

Accordingly, the present invention is directed to a heat exchanger with flat tubes that substantially obviates one or more problems due to limitations and disadvantages of the related art.

A first object of the present invention is to provide a heat exchanger with flat tubes each having multiple channels that have different refrigerant flow capacities from each other.

A second object of the present invention is to provide a heat exchanger with flat tubes each having multiple channels, in which the capacities of the multi-channels are increased or decreased at a predetermined rate according to a direction where exterior air flows.

A third object of the present invention is to provide a heat exchanger with flat tubes each having multi-channels, in which widths of the multi-channels are designed to increase or decrease a refrigerant flow capacity in response to a flow capacity of exterior air.

A fourth object of the present invention is to provide a heat exchanger with flat tubes each having multiple channels, in which a width of a foremost channel among the channels is broadest and a width of a rearmost channel among the channels is narrowest.

A fifth object of the present invention is to provide a heat exchanger with flat tubes each having multiple channels, in which adjacent channels among the channels have different widths.

A sixth object of the present invention is to provide a heat exchanger with flat tubes each having multiple channels, in which widths of the channels are decreased at a predetermined rate in a direction where exterior air flows.

A seventh object of the present invention is to provide a heat exchanger with flat tubes each having multiple channels each channel being provided at an inner circumference with a plurality of grooves.

An eighth object of the present invention is to provide a heat exchanger with flat tubes each provided at portions that do not contact cooling fins with ridge-shaped projections.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heat exchanger comprising: first and second header tanks through which refrigerant is introduced and discharged, the first and second header tanks being spaced apart from each other by a predetermined distance; a plurality of flat refrigerant tubes each having opposite ends respectively connected to the first and second header tanks, each of the refrigerant tubes having channels through which the refrigerant scatter and flow, the channels having a different capacity from each other, the first and second header tanks communicating with each other through the channels; and cooling means disposed between the refrigerant tubes, for radiating heat of the refrigerant flowing along the tubes.

Preferably, each of the refrigerant tubes comprises a refrigerant flow hole of a multi-channel structure having at least two different channel capacities to allow the refrigerant to scatter and flow.

Preferably, intervals between the channels are different from each other.

Preferably, among the channels, a first channel formed on a front end of each of the refrigerant tubes, has a biggest channel capacity, and an n-th channel formed on a rear end of each of the flat tubes has a smallest channel capacity, when the order of the first and the n-th is referenced by the air flow direction.

Preferably, the channel capacities of the refrigerant tubes are gradually decreased at a predetermined rate as it goes from a first channel formed on a front end of the refrigerant tube to an n-th channel formed on a rear end of the refrigerant tube.

Preferably, adjacent channels of each of the refrigerant tubes have a difference in their capacities and widths by a predetermined reduction/increase rate.

In another aspect of the present invention, there is provided a heat exchanger comprising: first and second header tanks through which refrigerant is introduced and discharged, the first and second header tanks being arranged spaced apart from each other by a predetermined distance; a plurality of flat refrigerant tubes arranged spaced away from one another by a predetermined distance and connected between the first and second header tanks, for dispersing and flowing refrigerant, each of the refrigerant tubes having a multi-channel structure in which a first channel, which is formed on a front end of each tube and first contacts air, has a biggest channel capacity, and an n-th channel, which is formed on a rear end of each tube, has a smallest channel capacity; and cooling fins disposed between the refrigerant tubes for heat discharge.

In another aspect of the present invention, there is provided a heat exchanger comprising: first and second header tanks through which refrigerant is introduced and discharged, the first and second header tanks being arranged spaced apart from each other by a predetermined distance; a plurality of flat refrigerant tubes each having multi-channels of which widths are gradually reduced by a predetermined reduction ratio as it goes in a direction where exterior air flows, the refrigerant tubes flowing refrigerant between the pair of header tanks through the multi-channels; and cooling fins disposed between the refrigerant tubes for heat discharge.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 8*a* is a perspective view of a flat tubes/fins assembly according to another embodiment of the present invention;

FIG. 8*b* is a sectional view taken along the line C–C' of FIG. 8*a.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
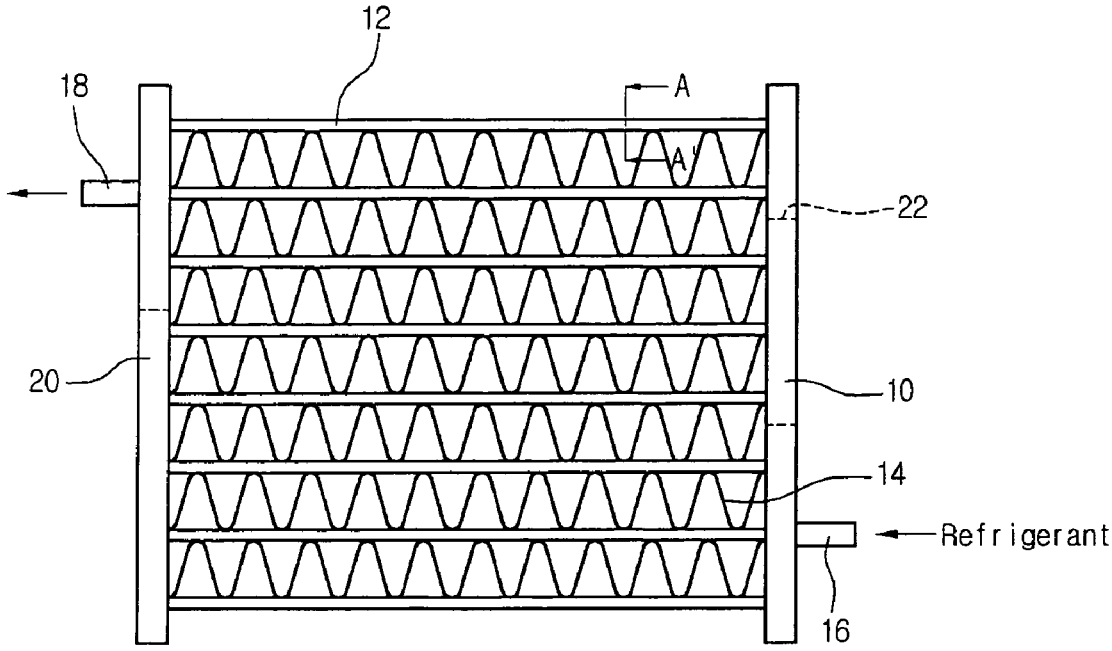
Fig.1 Related Art
FIG. 1 is a front view of a conventional heat exchanger with flat tubes.
Figure 2:
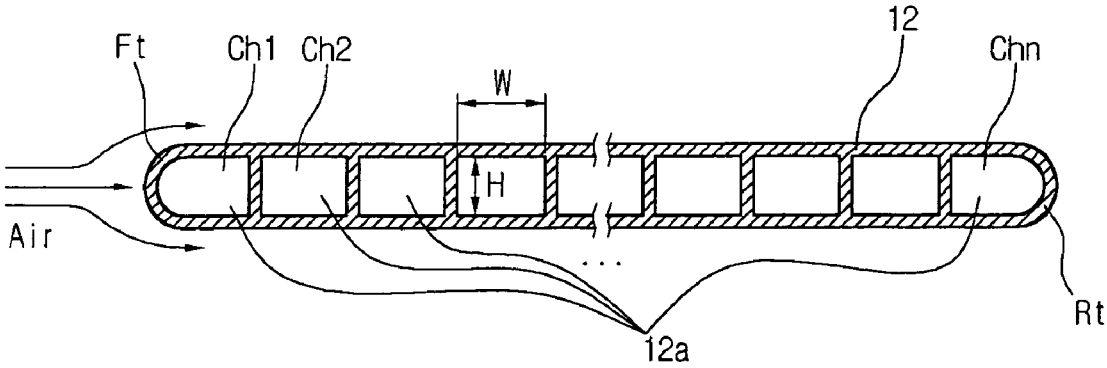
Fig.2 Related Art
FIG. 2 is a sectional view taken along the line A–A' of FIG. 1.
Figure 3:
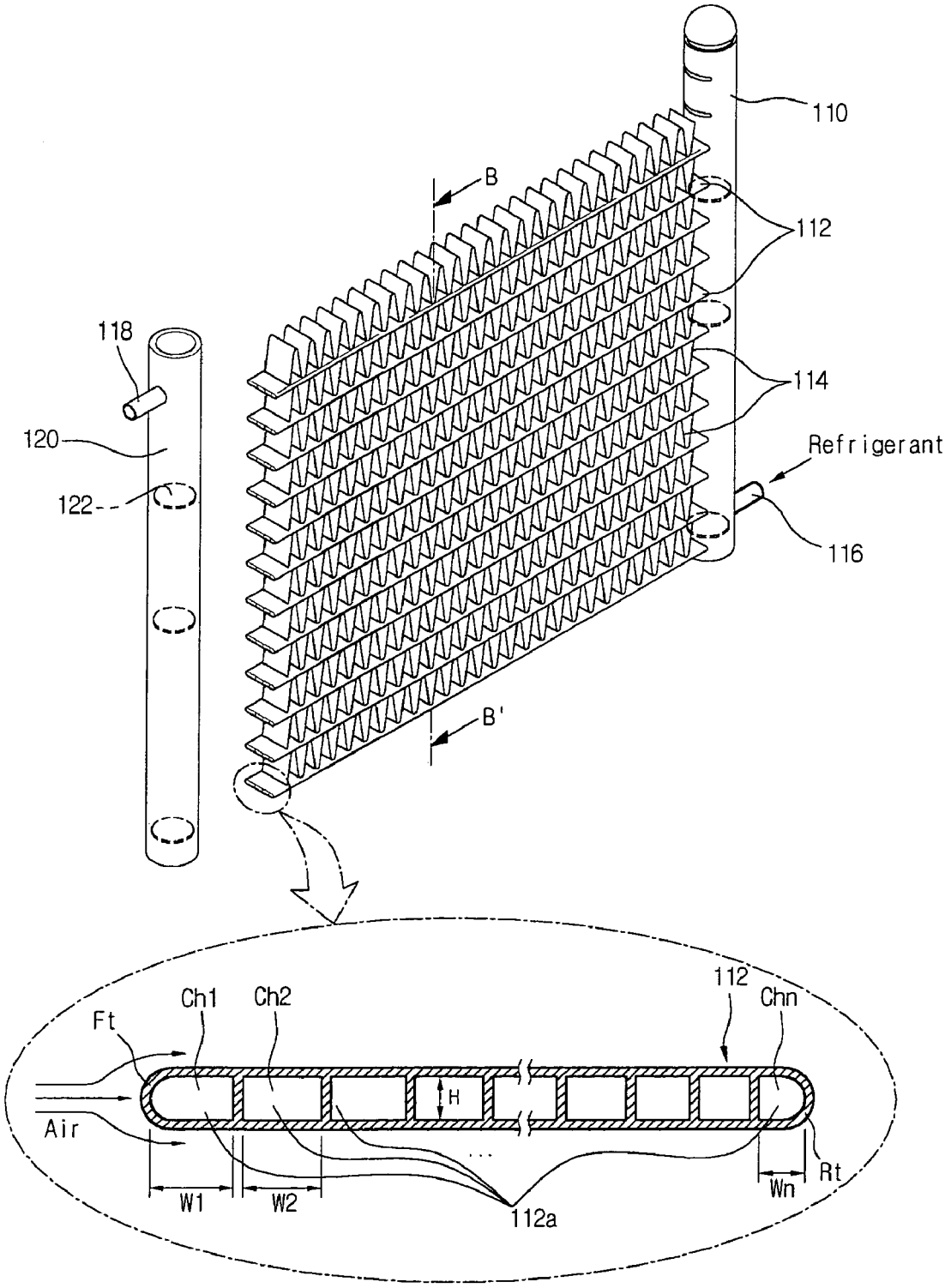
FIG. 3 is a perspective view of a heat exchanger with flat tubes according to an embodiment of the present invention.

FIG. 3 shows a perspective view of a heat exchanger with flat tubes according to an embodiment of the present invention.

As shown in FIG. 3, the inventive heat exchanger includes: first and second header tanks 110 and 120; a plurality of flat tubes 112 arranged in parallel and spaced apart from each other at an identical distance between the first and second header tanks 110 and 120, each of the flat tubes 112 having a plurality of refrigerant flow holes 112*a* defined by a plurality of channels Ch1–Chn having different capacities from each other to allow refrigerant to disperse and flow to the first and second header tanks 10 and 20; and cooling fins 114 disposed between the flat tubes 112 to radiate heat.

The first and second header tanks 110 and 120 are respectively connected to refrigerant inlet and outlet tubes 116 and 118. Each of the first and second header tanks 110 and 120 has therein one or more refrigerant separating membranes 122 for directing the refrigerant in a desired direction.

Next, operation and effects of the flat tube type heat exchanger constructed as above will be described with reference to the accompanying drawings.

Figure 4:
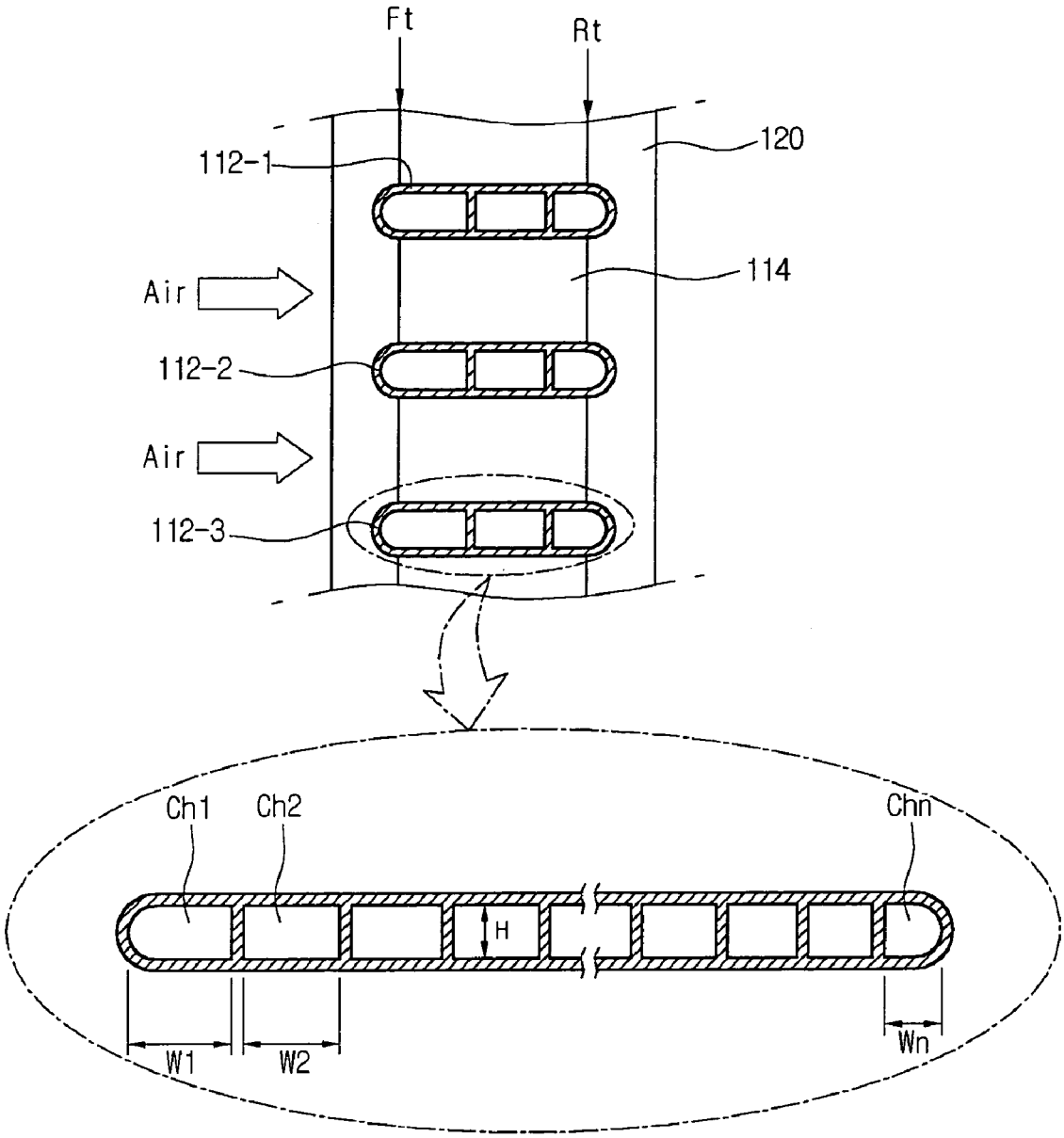
FIG. 4 is a sectional view taken along the line B–B' of FIG. 3.

Referring to FIGS. 3 and 4, the first and second header tanks 110 and 120 are arranged in parallel spaced apart from each other by a predetermined interval, and receive the refrigerant introduced through the refrigerant inlet tube 116. The received refrigerant flows through the tubes 112, is induced in a predetermined direction by the refrigerant separating membranes 122, and is then discharged through the refrigerant outlet tube 118.

The cooling fins 114 are disposed in a bellows shape inclined with a predetermined angle between the flat tubes 112 communicating the first and second header tanks 110 and 120 with each other.

The flat tube 112 is designed to allow the refrigerant to disperse and flow through the refrigerant flow holes 112*a* defined by the multiple channels Ch1–Chn. The 114 cooling fins surface-contact the outer surfaces of the tubes 112 and are inclined at a predetermined angle 45–90° to enlarge the cooling area.

Therefore, the tubes have a heat exchange capacity that is in proportion to an inner contacting area defined by the channels Ch1–Chn contacting the refrigerant, an outer contacting area defined by the cooling fins 114, and a flow capacity of the exterior air.

At this point, the tubes 112 affect the flow capacity of the refrigerant and the heat transfer in proportion to the channel capacity and the contact area. That is, the more the channel capacity (W X H) and the refrigerant contacting area, the higher the heat transfer efficiency.

In a modified example of the present invention, the channels Ch1–Chn of each tube 112 have different channel capacities or different channel widths from each other. As an example, it is preferable that the channels Ch1–Chn are formed with at least two different channel capacities or at least two different channel widths.

In addition, the first channel Ch1 that is located on a front end Ft of the tube 112 is designed having a widest width (W1), and the last channel Chn that is located on a rear end Rt of the tube 112 is designed having a narrowest width (Wn) so that the last channel has a smallest channel capacity.

That is, since the exterior air is introduced into the first channel Ch1 and discharged through the last channel Chn, the first channel Ch1 that first contact the exterior air is designed having the highest refrigerant flow capacity in proportion to the heat transfer rate and the channel capacity, and the last channel Chn that lastly contact the exterior air is designed having the lowest refrigerant flow capacity.

Alternatively, all of the channels Ch1–Chn of each of the tubes 112 have different channel widths W1–Wn from each other. Preferably, the channel widths W1–Wn of the first to last channels Ch1–Chn that are arranged in this order in a direction where the interior air flows are gradually reduced at a predetermined rate as they go toward the air discharge direction. That is, intervals between the channels are gradually reduced.

In other words, when assuming that a channel, which is located on a front end Ft of the tube 112 and first contacts exterior air, a is first channel (Ch1), a channel, which is adjacent to the first channel (Ch1), is a second channel, and a channel, which is located on a rear end, is an n-channel, a width W1 of the first channel Ch1 is greater than that of the second channel Ch2 by a predetermined length. The widths of adjacent channels can be adjusted at an identical reduction rate. For example, a reduction ratio of the width (W2) of the second channel to the width (W1) of the first channel may be set to 6% or 10%. In other words, the widths W1–Wn of the first to last channels Ch1–Chn may be gradually reduced at a reduction rate of 6% or 10%.

That is, as shown in FIG. 3, when the width reduction rate is set to 6%, the width W2 of the second channel Ch2 is less than that W1 of the first channel Ch1 by 6%, the width W3 of the third channel Ch3 is less than that W2 of the second channel Ch2 by 6%, . . . , and the width Wn-1 of the channel Chn-1 is less than that Wn of the last channel Chn by 6%. Therefore, the relationship of the widths W1 and Wn of the respective first and last channels Ch1 and Chn become W1>>Wn.

Likewise, as shown in FIG. 4, the flat tubes 112 (112-1, 112-2, 112-3, . . . , 112-n) arranged in parallel at a constant interval are designed such that the channels having an identical channel number have an identical channel width (W) and the channels having different channel numbers have different channel widths, and the width of all the channels is reduced at a constant rate according to the order of the channels (Ch1, Ch2, . . . Chn). In a modified example, the outermost tubes (the uppermost and lowermost tubes) can be designed to be different in their width from the tubes located at a center portion of the heat exchanger. That is, some channels located at the center portion are designed as in FIG. 3, and the channels of the outermost tubes are designed as in the conventional art.

Figure 5:
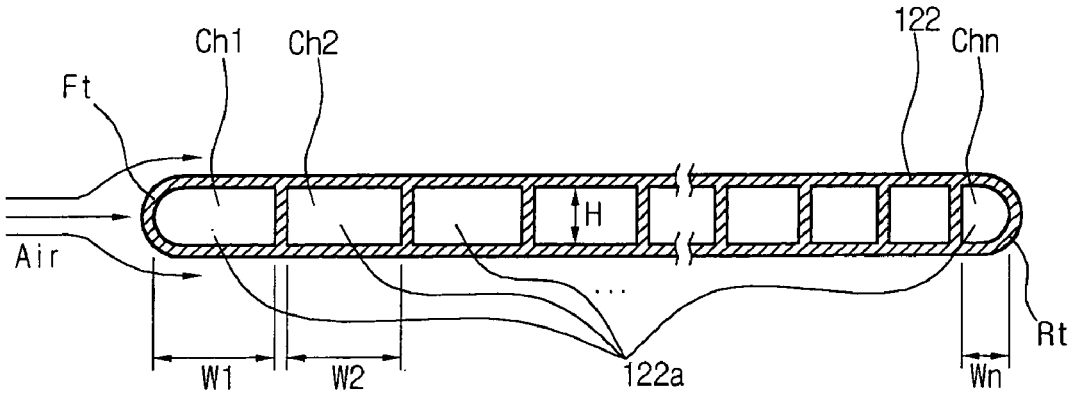
FIG. 5 is a sectional view of a modified example of a flat tube depicted in FIG. 3.

FIG. 5 shows a modified example of the flat tube according to the present invention.

In this modified example, the width reduction rate is set to 10%. That is, the width W2 of the second channel Ch2 is less than that W1 of the first channel Ch1 by 10%, the width W3 of the third channel Ch3 is less than that W2 of the second channel Ch2 by 10%, . . . , and the width Wn of the last channel Chn is less than that Wn-1 of the channel Chn-1 by 10%. Therefore, the relationship of the widths W1 and Wn of the respective first and last channels Ch1 and Chn become W1>>Wn.

This modified example shows that the width reduction rate is set in a range of about 6–10% in proportional to a flow rate of exterior air and a flow rate of the refrigerant. On the contrary, the widths of the adjacent front and rear channels in the first to last channels may be set at a width increase rate of 6–10%.

Alternatively, the tubes may be configured such that the channels Ch1–Chn are grouped into two or three groups, and the widths of the groups are set to be different from each other.

Alternatively, the tubes may be configured such that the width W1 of the first channel Ch1 is necessarily greater than the width Wn of the last channel Chn, and the ratio of the widths of adjacent two channels except for the first and last channels Ch1 and Chn is identical or different to or from each other. In addition, even though the width reduction rate or width increase rate of the channels in the tubes 112 (or 122) is adjusted, the sum of the sectional areas of the multiple channels Ch1–Chn may be identical to that of the conventional art.

The width reduction or increase rate (ex. 6–10%) of the channels Ch1–Chn is determined depending on a heat transfer amount at the front end 112*b* (or 122*b*) of the tubes 112 (or 122) or an expected heat transfer efficiency. Alternatively, by varying a ratio of heights H of the channels, it is also possible to improve the heat transfer efficiency. Alternatively, by varying ratios of the heights H and widths W, it is also possible to improve the heat transfer efficiency.

Figure 6:
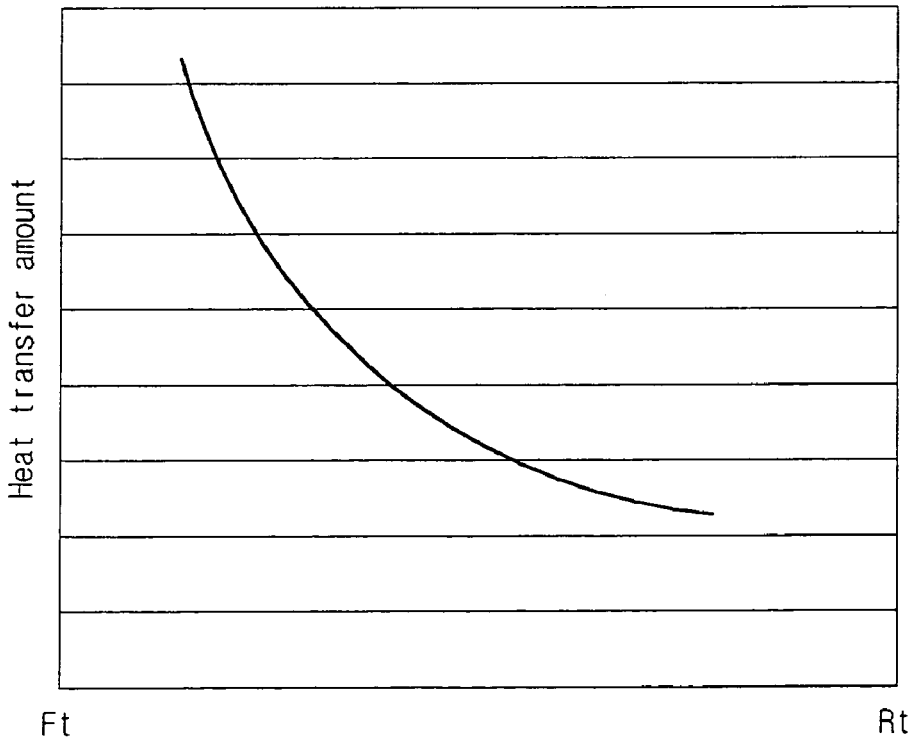
FIG. 6 is a graph illustrating a variation of a heat transfer rate in accordance with regions of a heat exchanger.

FIG. 6 shows a graph illustrating a variation of a heat transfer rate at the tube of the present invention. As shown in FIG. 6, the heat transfer amount is largest at the front end Ft of the tube that first contacts the air and is then gradually reduced as it goes to the rear end Rt of the tube. That is, in the fin-tube-type heat exchanger, the heat transfer amount in the front end Ft of the tube is about 80% of an amount of overall heat transfer of the heat exchanger. Accordingly, by making the width W1 of the first channel Ch1 located on the front end Ft of the tube where the heat exchange is most active to be widest so that a large amount of refrigerant can flow along the first channel Ch1, an amount of overall heat transfer can be increased.

In addition, even though the sectional areas of the channels are different from each other, if the walls between the channels are designed having an identical thickness to each other, the sum of the sectional areas of the channels becomes identical to that of channels designed having an identical sectional area to each other. Alternatively, the widths of the channels located on the front side of each tube may be different depending on air contact amount.

Figure 7:
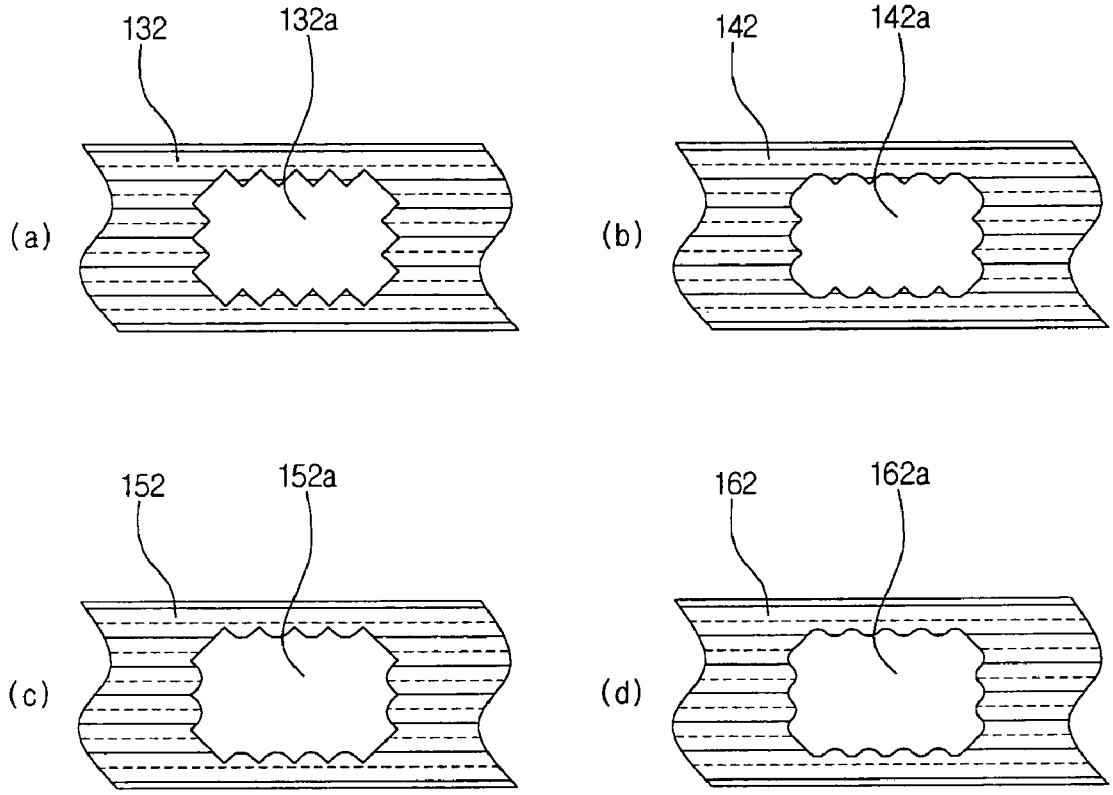
FIG. 7 is a view illustrating various examples of a refrigerant flow hole formed in a flat tube according to another embodiment of the present invention.

FIG. 7 shows various examples of a refrigerant flow hole formed in a flat tube according to another embodiment of the present invention;

As shown in (a) to (d) of FIG. 7, an inner circumference of a refrigerant flow hole 132*a*, 142*b*, 152*c* or 162*d* formed in the tube 132, 142, 152 or 162 is formed in a variety of sectional shapes such as a groove, an irregular surface, or a parabola. In other words, in the modified examples of FIGS. 7(*a*) to 7(*d*) having a plurality of grooves as to increase the contact area with the refrigerant, thereby improving the heat discharge efficiency.

Figure 8:
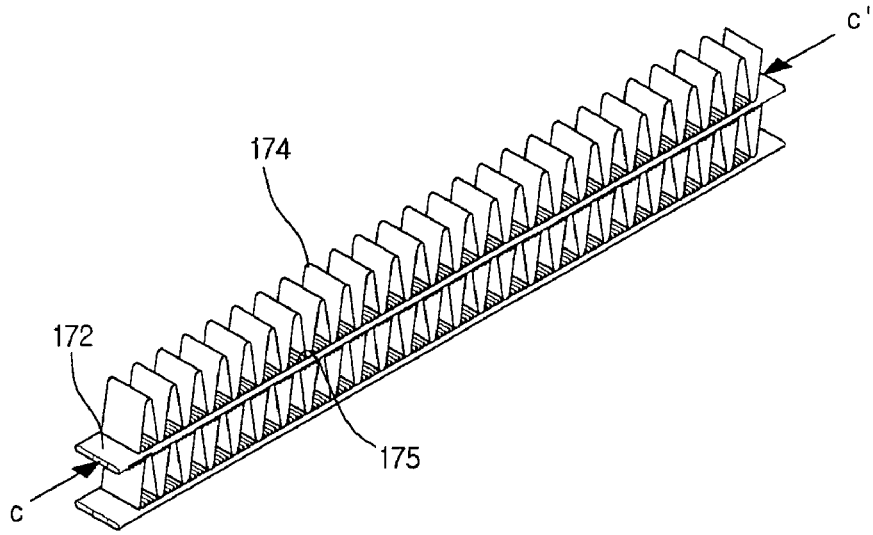
Figure 8:
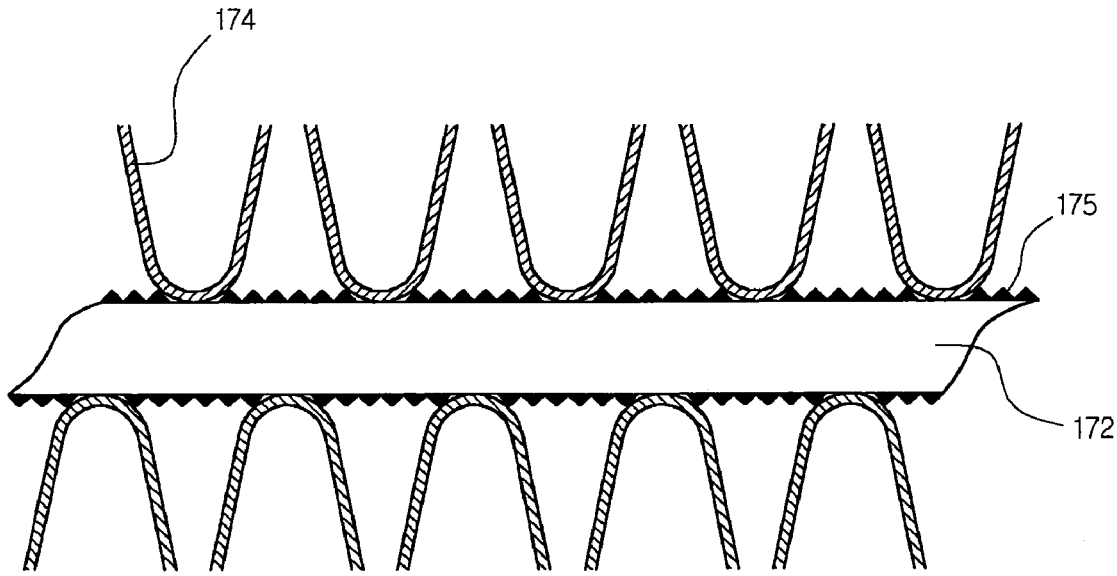
Figure 9:
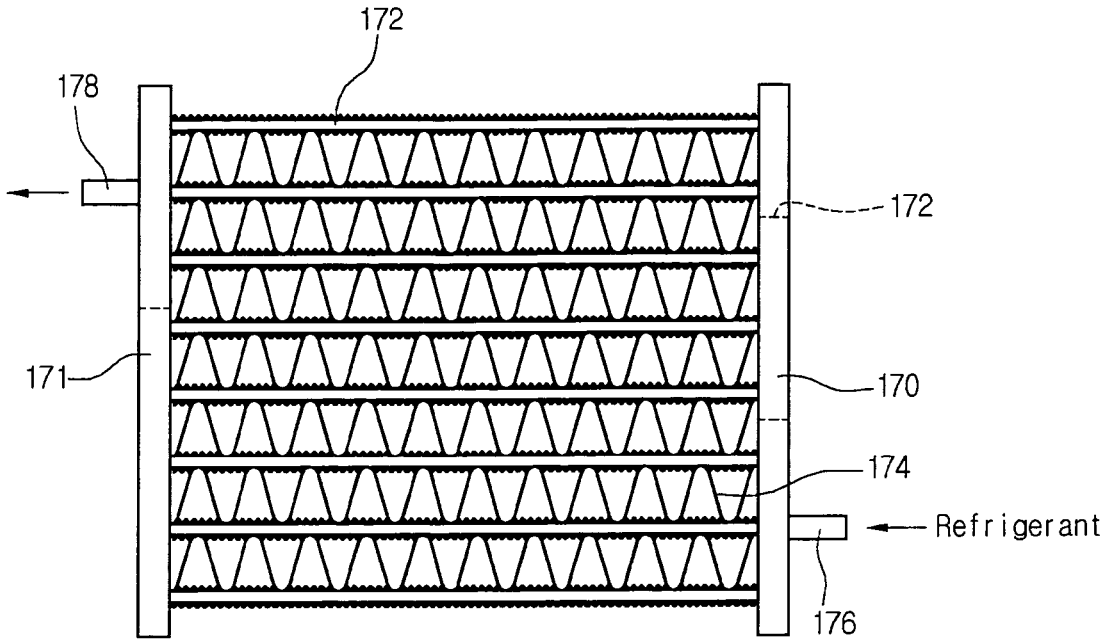
* and FIG. 9 is a front view of a heat exchanger where the flat tubes/fins assembly depicted in FIG. 8*a* is employed.

FIGS. 8*a*, 8*b* and 9 show another embodiment of the present invention.

Referring first FIGS. 8*a* and 8*b*, each of tubes 172 is provided at portions of its outer surface, which do not contact cooling fins 174, with a plurality of riblets 175 arranged in parallel in a direction where air flows. Therefore, the heat exchange between refrigerant flowing along the tube and exterior air can be increased by the riblets 175 as well as the cooling fins 174 as shown in FIG. 9.

That is, the cooling fins 174 are vertically disposed between the tubes 172 at a predetermined inclined angle, and the riblets 175 are integrally formed on portions of the outer surface of the tube, which do not contact cooling fins 174. A section of each riblet 175 is formed in a ridge-shape or a triangular-shape to (a) increase the contact area with the exterior air, (b) reduce the pressure drop, and (c) enhance the air flow rate.

As described above, the cooling fins 174, the riblets 175, and the multi-channels Ch1–Chn function to increase contact area, to maximize the heat transfer efficiency and to minimize the pressure drop.

In FIG. 9, a heat exchanger is shown in which heat radiating means 174, 175 having different shapes and materials are formed on tubes 172 connected between a pair of header tanks 170 and 171.

According to the above described modified example, since the inner circumference of the tube is designed having heat radiating means shaped in a groove and the outer surface of the tube is designed having heat radiating means including cooling fins and riblets, and the heat radiating means are integrated, an overall contact area of the heat exchanger is increased to thereby maximize the heat transfer efficiency.

In addition, since the channels formed in the tube are designed having different width ratio and height ratio from each other in response to air flow capacity, it is possible to increase heat transfer rate.

As described previously, according to the present invention, capacities of channels of a tube are formed different according to the flow rate of exterior air and air contact amount so that refrigerant flow rate and heat transfer rate in a heat exchanger are increased.

Also, among the channels of a refrigerant tube, a first channel, which most frequently contacts exterior air, is designed having the greatest width and an n-th channel, which least frequently contacts exterior air, is designed having the smallest width so that it is possible to increase refrigerant flow rate according to flow rate of exterior air.

In addition, the refrigerant tube is designed having a channel capacity or a channel width, which is reduced from the front end to the rear end by a constant reduction rate of 6–10% so that it is possible to increase a heat transfer amount at a local portion of the refrigerant tub or a total heat transfer amount.

Further, the inner circumference of the channels of the refrigerant tube is designed having grooves and the outer surface of the tube is designed having riblets so that the contact area of the heat exchanger with refrigerant is increased to thereby maximize the heat transfer efficiency, increase exterior air contact area and reduce the pressure loss.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heat exchanger comprising:

first and second header tanks through which refrigerant is introduced and discharged, the first and second header tanks being spaced apart from each other by a predetermined distance;

a plurality of flat refrigerant tubes each having opposite ends respectively connected to the first and second header tanks, each of the refrigerant tubes having channels spaced apart from one another in a widthwise direction through which the refrigerant scatter and flow, the channels having a different capacity from each other, the first and second header tanks communicating with each other through the channels; and cooling means disposed between the refrigerant tubes, for radiating heat of the refrigerant flowing along the tubes, wherein widths of the channels are different from each other and heights of the channels are the same as each other.

2. The heat exchanger according to claim 1, wherein each of the refrigerant tubes comprises a refrigerant flow hole of a multi-channel structure having at least two different channel capacities to allow the refrigerant to scatter and flow.

3. The heat exchanger according to claim 1, wherein intervals between the channels are different from each other.

4. The heat exchanger according to claim 1, wherein among the channels, a first channel formed on a front end of each of the refrigerant tubes, has a biggest channel capacity, and an n-th channel formed on a rear end of each of the flat tubes has a smallest channel capacity, when the order of the first and the n-th is referenced by the air flow direction.

5. The heat exchanger according to claim 1, wherein the channel capacities of the refrigerant tubes are gradually decreased at a predetermined rate as it goes from a first channel formed on a front end of the refrigerant tube to an n-th channel formed on a rear end of the refrigerant tube.

6. The heat exchanger according to claim 5, wherein adjacent channels of each of the refrigerant tubes have a difference in their capacities by a predetermined reduction/increase rate.

7. The heat exchanger according to claim 1, wherein the channels are classified into the predetermined number of groups, and capacities of the grouped channels are different from each other.

8. The heat exchanger according to claim 1, wherein widths of the channels are gradually reduced at a predetermined rate as it goes from a first channel formed on a front end of the refrigerant tube to an n-th channel formed on a rear end of the refrigerant tube.

9. The heat exchanger according to claim 8, wherein the channel widths of the adjacent front and rear channels are reduced at a reduction rate of 6%.

10. The heat exchanger according to claim 8, wherein the channel widths of the adjacent front and rear channels are reduced at a reduction rate of 10%.

11. The heat exchanger according to claim 1, wherein an inner circumference of the tubes comprises an irregular surface having a plurality of irregular grooves formed in the inner circumference.

12. The heat exchanger according to claim 1, wherein the cooling means comprises cooling fins vertically disposed between the flat tubes, and riblets formed in air flow direction on an outer surface where the cooling fins are not formed.

13. A heat exchanger comprising:

first and second header tanks through which refrigerant is introduced and discharged, the first and second header tanks being arranged facing each other spaced apart from each other by a predetermined distance and having at least one separation membrane;

a plurality of flat refrigerant tubes each having opposite ends respectively connected between the first and second header tanks, each of the flat tubes being provided with multi-channels spaced apart from one another in a widthwise direction and having different channel widths in an exterior air flow direction and having same channel heights, and communicating the first and second header tanks with each other to disperse and flow the refrigerant; and heat discharging means including: a plurality of cooling fins disposed in a predetermined shape between the refrigerant tubes; and riblets protruded in the air flow direction on an outer surfaces of the refrigerant tubes.

14. The heat exchanger according to claim 13, wherein the riblets are shaped in a triangle.

15. The heat exchanger according to claim 13, wherein each of the tubes has an inner circumference comprising an irregular surface having a plurality of irregular grooves formed in the inner circumference.

16. A heat exchanger comprising:

first and second header tanks through which refrigerant is introduced and discharged, the first and second header tanks being arranged spaced apart from each other by a predetermined distance;

a plurality of flat refrigerant tubes arranged spaced apart from one another by a predetermined distance and connected between the first and second header tanks, for dispersing and flowing refrigerant, each of the refrigerant tubes having a multi-channel structure including channels spaced apart from each other in a widthwise direction and in which a first channel, which is formed on a front end of each tube and first contacts air, has a biggest channel capacity, and an n-th channel, which is formed on a rear end of each tube, has a smallest channel capacity; and cooling fins disposed between the refrigerant tubes for heat discharge, wherein widths of the channels are different from each other and heights of the channels are the same as each other.

17. A heat exchanger comprising:

a plurality of flat refrigerant tubes each having multi-channels including channels spaced apart from each other in a widthwise direction and of which widths are gradually reduced by a predetermined reduction ratio as it goes in a direction where exterior air flows and of which heights are the same, the refrigerant tubes flowing refrigerant between a pair of header tanks through the multi-channels; and cooling fins disposed between the refrigerant tubes for heat discharge.

18. The heat exchanger according to claim 16, wherein the tubes have an inner circumference comprising an irregular surface having a plurality of irregular grooves formed in the inner circumference.

19. The heat exchanger according to claim 17, wherein the tubes have an inner circumference comprising an irregular surface having a plurality of irregular grooves formed in the inner circumference.

* * * * *